US005415095A

United States Patent [19]

Rennerfelt

[11] Patent Number: 5,415,095

[45] Date of Patent: May 16, 1995

[54] ROLLER WHICH INCORPORATES MEANS FOR MOVING THE ROLLER AXIALLY

[76] Inventor: Gustav Rennerfelt, Nilstorpsvägen 53, Lidingö S-181 47, Sweden

[21] Appl. No.: 190,190

[22] PCT Filed: Oct. 8, 1992

[86] PCT No.: PCT/SE92/00709

§ 371 Date: Feb. 10, 1994

§ 102(e) Date: Feb. 10, 1994

[87] PCT Pub. No.: WO93/06999

PCT Pub. Date: Apr. 15, 1993

[30] Foreign Application Priority Data

Oct. 9, 1991 [SE] Sweden ..... 9102938

[51] Int. Cl.[6] ..... B41F 31/15

[52] U.S. Cl. ..... 101/348; 101/DIG. 38

[58] Field of Search ..... 101/348, 349, DIG. 38; 492/15; 74/22 R

[56] References Cited

U.S. PATENT DOCUMENTS

| | | | |
|---|---|---|---|
| 2,040,331 | 5/1936 | Peyrebrune | 101/348 |
| 2,520,688 | 8/1950 | Meyer et al. | 101/DIG. 38 |
| 3,625,148 | 12/1971 | Muselik et al. | 101/DIG. 38 |
| 4,646,638 | 3/1987 | Theilacker | 101/349 |
| 5,030,184 | 7/1991 | Rennerfelt | 475/162 |
| 5,054,393 | 10/1991 | MacPhee | 101/DIG. 38 |
| 5,230,285 | 7/1993 | Cogswell et al. | 101/DIG. 38 |

FOREIGN PATENT DOCUMENTS 2045717 3/1972 Germany .

*Primary Examiner*—Edgar S. Burr
*Assistant Examiner*—Stephen R. Funk
*Attorney, Agent, or Firm*—Young & Thompson

[57] ABSTRACT

A mechanism for insertion into one end of a distribution cylinder in printing machines for converting the rapid rotational movement of the cylinder to a slow reciprocating cylinder movement. The other end of the distribution cylinder is journalled in a stationary shaft fixedly mounted in a printing machine frame. The mechanism is mounted above the stationary shaft and includes a cylinder (2) which is intended to be fixed in the distribution cylinder. The cylinder (2) is journalled for rotation around the stationary hollow shaft (1). A camming groove element (8; 8A) is fixed axially on the stationary hollow shaft (1) and is journalled for rotation about the symmetry axis (24, 25) thereof. A runner-camming groove-unit (13, 9) facilitates the slow, relative rotation of the camming groove element to an axial reciprocating movement of the cylinder (2), therewith causing the distribution cylinder to move axially backwards-and-forwards.

10 Claims, 4 Drawing Sheets

ROLLER WHICH INCORPORATES MEANS FOR MOVING THE ROLLER AXIALLY

BACKGROUND OF THE INVENTION

1. Field of the Invention

The present invention relates to distribution cylinders in printing machines, and more specifically to a distribution cylinder which incorporates a mechanism which enables the cylinder to move axially, backwards and forwards, at the same time as it rotates.

2. Description of the Related Art

Distribution cylinders are used in printing machines to smooth-out the ink layer on one or more printing contra-rotating rollers. By enabling the distribution cylinder to be driven by the contra-rotating printing roller or rollers at the same time as the cylinder is moved reciprocatingly in the direction of its long axis, the ink layer which ultimately meets the printing platen is smoothed-out or equalized. Poor equalization of the ink layer will result in print defects, such as striped print.

This axial, reciprocating movement of the distribution cylinder should be a uniform, sinusoidal movement whose frequency is coupled to the printing speed. This frequency depends on many machine factors, but normally often lies in the range of 0.5–2 Hz at normal printing speeds. The distribution cylinder should not vibrate at right angles to the cylinder surface, since such vibrations are liable to result in undesirable patterns in the ink layer to be equalized.

This axial movement of the cylinder is typically achieved with constructions that include levers, reduction gears and camming curves, all of which are fitted externally on the machine frame, within protective panels. It is also normal for each inking device to include up to four distribution cylinders. It will be understood that many mechanical mechanisms of the aforesaid kind are normally required to generate reciprocatory movement of all of such cylinders.

The incorporation of a mechanism within a distribution cylinder in order to achieve this axial movement is an old concept which has been applied in sheet-offset-printing machines. The distribution cylinders in these machines do not rotate as fast as the cylinders in modern web-offset-printing machines. Consequently, it is not necessary for the reduction of the ratio between cylinder speed and the frequency of the axial movement of the cylinder to be as great. A typical reduction in these known constructions is 9:1.

A known construction of this kind cannot be transferred to web-offset-printing machines, since the rollers of such machines rotate at high speeds and the low reduction ratio would then result in an axial movement frequency of such high magnitude as to risk the occurrence of harmful vibrations.

It is true that a satisfactory reduction ratio, which preferably lies in the range 30:1–40:1, could be achieved by incorporating multi-step gearboxes. Such a construction will afford a number of advantages, such as high efficiency, long useful life, long periods between servicing, low price, ease of exchange of the whole of the mechanism or parts thereof without disturbing the distribution cylinder, generally speaking independent of cylinder length.

A construction of this kind, however, also has serious drawbacks, such as:

a) Strict balancing requirements with regard to the complete distribution cylinder. In the case of cylinder diameters of about 75 mm, the normal maximum imbalance demand is about 6 gcm (gram-centimeter).

b) Low gear mechanism efficiency. Heat emission along the cylinder, which influences the viscosity of the ink and therewith the quality of the resultant print.

c) The load-carrying parts of the gear mechanism will have a short useful life, due to the large number of moveable parts and the play that occurs in time, coupled with relatively frequent services.

d) The construction is also expensive, due to the large number of moveable parts.

The German published specification No. 2 045 717 describes a distribution cylinder mechanism which comprises a single-step reduction gear and a cam-curve unit. The reduction gear is comprised of an eccentrically journalled gearwheel which meshes with an internally toothed annulus connected to the rotary cylinder. With the gear reduction possibilities available at that time, it was possible to achieve a maximum reduction of about 9:1 in this single step. The externally-toothed wheel journalled on the stationary eccentric transmits a slightly increased speed to the cam-curve unit, through the medium of an x-y-link mechanism.

The known distribution cylinder mechanism has two basic features which render it unsuitable for use in rapid, web-offset-printing machines, namely:

1) The reduction is too low. This means that axial movement of the cylinder will take place with an impermissibly high frequency, far above the desired frequency which, as before mentioned, lies in the range of 0.5–2 Hz. In order to obtain sufficiently high reduction, another gear solution is required, for instance the solution described in my U.S. Pat. No. 5,030,184.

2) The x-y-linkage transfer mechanism is intended to transmit the rotary motion of the eccentrically journalled gearwheel to the rotational axle of the cam-curve unit. The mass of the x-y-linkage mechanism creates an imbalance, resulting in vibrations and frictional heat.

It is possible, of course, to substitute an x-y-linkage system with a universal drive shaft, diaphragm couplings or arcuate toothed couplings. This would make the construction more complicated, however, and therewith expensive. In addition, a construction of this kind would include many components which may become loose because of excessive play and therewith give rise to imbalance and vibrations.

SUMMARY OF THE INVENTION

The object of the present invention is to avoid the aforesaid problems. This object is achieved with an arrangement of the kind defined in the claims and having the characteristic features set forth therein.

BRIEF DESCRIPTION OF THE DRAWINGS

The invention will now be described in more detail with reference to various embodiments of the invention and with reference to the accompany drawings, in which.

DESCRIPTION OF THE PREFERRED EMBODIMENTS

Figure 1:
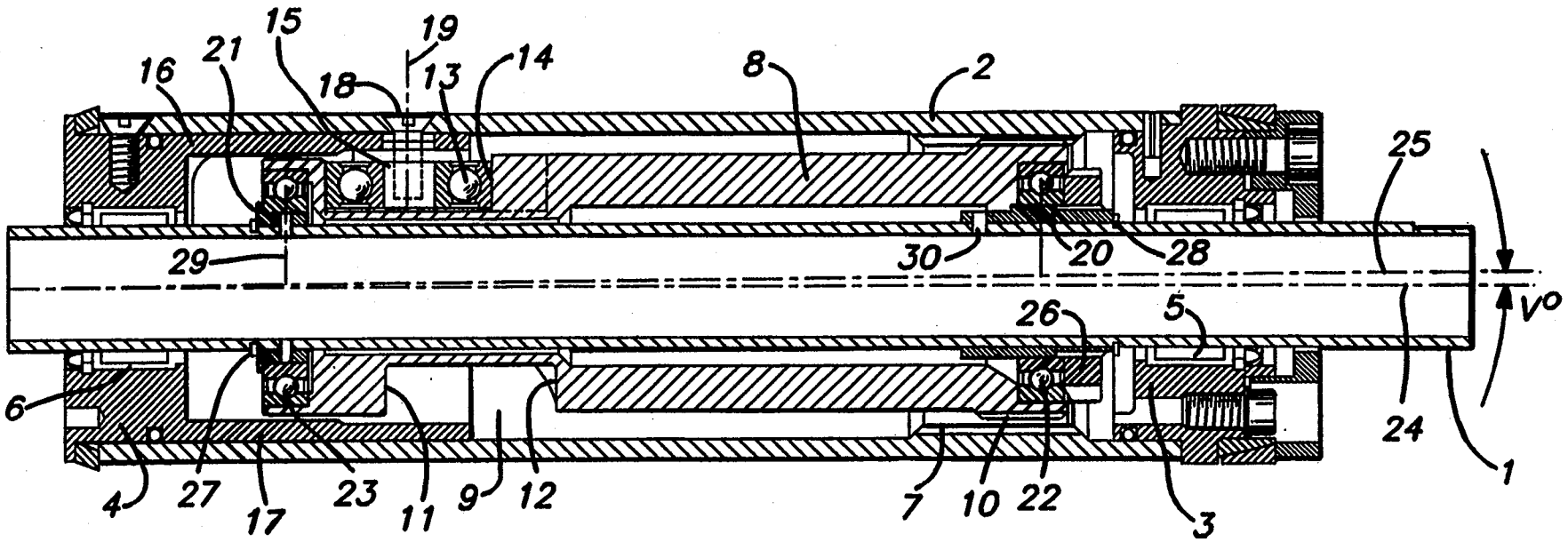
FIG. 1 is an axial sectional view of a distribution cylinder provided with the inventive arrangement.

FIG. 1 illustrates an arrangement according to the invention. The arrangement is contained in a module which is intended to be inserted into one end of a distribution cylinder, or ink-smoothing cylinder, and fixed thereto. The inventive arrangement is mounted on a hollow shaft. Although not shown, a central distribution cylinder axle extends through the hollow shaft 1 and the other end of the distribution cylinder is journalled on the central axle. This central axle (not shown) is connected to a printing machine frame. A cylinder 2 is mounted for rotation on the hollow shaft by means of end-walls 3, 4 and needle-bearings 5, 6. The hollow shaft 1 and the central axle (not shown) are stationary. The distribution cylinder, and therewith the cylinder 2, are driven at a high rotational speed with the aid of means not shown. This rotary movement shall be converted to a slow, axial movement of the cylinder 2 with the aid of the inventive arrangement. The frequency of this axial movement shall be in the order of 0.5 Hz.

In order to move the cylinder 2 axially, the cylinder has a toothed ring or annulus 7 provided with internal teeth on the internal surface of the cylinder. A cylindrical camming toothed element 8 has a camming groove 9 at one end thereof and a toothed ring or annulus 10 with external teeth on the other end thereof. The camming groove 9 has two camming surfaces 11, 12. A roller or runner 13 runs in the camming groove 9 and includes a ball bearing having a cambered or crowned running surface 14. The runner is provided with a pin 15 which passes through one part 16 of a collar 17 on the end-wall 4. The pin 15, and therewith the runner 13, are fastened to the cylinder 2 by means of a screw 18. The runner rotates around a rotational axis 19. When seen in the circumferential direction of the camming gear element 8, the camming groove 9 has a sinusoidal configuration.

The cylindrical camming gear element 8 is positioned obliquely at an angle V degrees in relation to the hollow shaft 1, by means of two bushings 20, 21, mounted on the hollow shaft 1. The camming gear element is rotatably journalled by means of ball bearings 22, 23 mounted on a respective end of said element. The ball bearing 22 is mounted on the bushing 20 and the ball bearing 23 on the bushing 21.

The symmetry axis of the hollow shaft 1 is referenced 24 while the symmetry axis of the cylindrical cam gear element is referenced 25. In one preferred embodiment, the angle V between the symmetry axes 24, 25 is 0.45 degrees. The outer cylindrical surfaces of the bushings 20, 21 are also at an angle of V degrees in relation to the symmetry axis 24. The bushing 20 has the form of an eccentric annulus. The eccentricity of the annulus is chosen so that the external teeth on the toothed annulus 10 will mesh with the teeth of the annulus 7. The angled eccentric bushing 20, the ball bearing 22, the toothed annulus 10 and the toothed annulus 7 together form an eccentric gear assembly. The eccentric gear assembly is preferably constructed in the manner described in my U.S. Pat. No. 5,030,184, meaning that the difference between the number of teeth on the annulus 7 and the number of teeth on the annulus 10 is in the order of 1 to 2. Since the gear-camming element 8 is inclined, it is also appropriate to give the annulus 10 a conical configuration with a cone angle $2 \times V$ degrees. This will result in line abutment between the mutually meshing teeth. The teeth on the toothed annulus 7 have an axial length such as to always achieve meshing engagement between the annulus 7 and the annulus 10, irrespective of the axial position of the cylinder 2.

The entire assembly comprising camming gear element 8, ball bearings 22, 23 and bushings 20–21, is held clamped axially by means of a nut 26, which is preferably screwed very tightly and thereafter fixated with the aid of glue or some corresponding means. The axial position of the assembly on the hollow shaft 1 is fixed with the aid of circlips 27, 28. The angled bushing 21 and the eccentric bushing 20 are affixed by means of respective cylindrical pins 29, 30, so that the mutual angular position between said bushings is maintained.

In the case of the preferred embodiment, the toothed annulus 7 has seventy teeth and the toothed annulus 10 sixty-eight teeth. When the cylinder 2 has completed one revolution, the cylindrical camming gear element 8 will have rotated one revolution plus two tooth divisions. In other words, the cylinder 2 and the camming gear element 8 have rotated two tooth divisions in relation to one another. The camming gear element 8 thus rotates slowly in relation to the cylinder 2 on which the runner 13 is mounted. However, both the cylinder 2 and the camming gear element 8 rotate at a very high speed relative to the stationary hollow shaft 1.

During this slow, relative rotation between the cylinder 2 and the camming gear element 8, the runner 13 moves along the camming groove 9 therewith causing the cylinder 2 to move slowly in the direction of its main axis. In the preferred embodiment, it is necessary for the cylinder 2 to rotate thirty-four (34) revolutions in order to achieve an axially-reciprocating movement of, e.g., 20 mm top-to-top value. The runner 13 has an external diameter which is about 0.03 mm smaller than the width of the camming groove 9. The runner rolls alternately against the one and the other camming surface 11, 12, depending on the direction in which the cylinder 2 moves axially.

In the axial section view of FIG. 1, the bushing 20 is positioned so that its eccentricity is maximum at its upper defining surface. Thus, when the camming gear element 8 takes the position shown in FIG. 1, the camming groove 9 will be inclined at an angle of V degrees in relation to the rotational axis 19 of the runner. When the camming gear element is rotated 90° from this position, the rotational axis 19 and the camming groove 9 will be parallel. When the camming gear element is then rotated through a further 90°, the angle defined by the rotational axis 19 and the camming surface will be V degrees in the opposite direction (in relation to the position shown in the Figure).

The camming surfaces 11, 12 thus "wobble" through an angle $\pm V$ degrees in relation to the runner rotational axis 19. This "wobbling" movement takes place at a high frequency and corresponds to the rotational speed of the cylinder 2. A rotational speed in the order of 1200–2000 r.p.m. is not unusual, corresponding to a "wobbling" frequency in the order of 20–33 Hz. If the running surface of the runner 13 were to be cylindrical, this "wobbling" movement would cause the camming surfaces 11, 12 to be clamped against the upper and lower runner edges respectively. Such edge abutment is undesirable, since this would prevent the runner 13 from rotating, with subsequent damage to the runner ball bearings. One advantage afforded by the present invention is that the running surface of the runner 13 is cambered (arched). This camber takes-up the "wobbling" movement of the camming surface. As a result of the camber, the contact between runner and camming surfaces 11, 12 is punctiform and the runner runs up-and-down in relation to the equatorial plane of the camber.

Because the camming gear element 8 is positioned obliquely in relation to the symmetry axis 24, the runner will roll on the camming surfaces 11, 12 at different radial distances from the symmetry axis 24 of the hollow shaft. This has no deleterious effect, since the runner is cambered and the camber will enable the point of contact to be displaced up and down along the cambered surface.

A ball bearing always has a given degree of self-adjustment, and this self-adjustment of the ball bearing of the runner 13 further ensures that edge abutment will not occur.

The aforedescribed embodiment of the invention can be modified. One alternative is to provide the camming groove 9 on the inner surface of the cylinder 2, and to fix the runner 13 on the camming gear element 8. Another alternative is to choose other ratios between cylinder speed and the frequency of the axial movement, and also to choose amplitudes and movement patterns other than sinusoidal. Instead of using a runner in the form of a ball bearing having a cambered surface, there can be used a spherical bearing.

Figure 2:
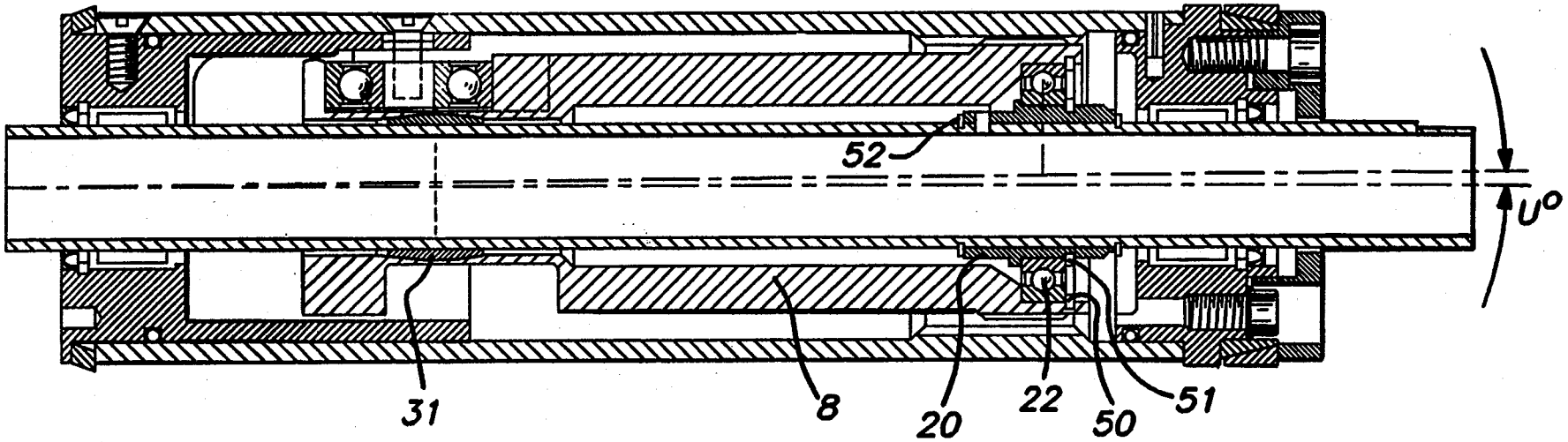
FIG. 2 illustrates a modified embodiment of the arrangement shown in FIG. 1.

FIG. 2 illustrates another embodiment of the arrangement according to FIG. 1, in which the bushing 21 and the ball bearing 23 have been replaced with a spherical slide bearing 31 which is located centrally beneath the camming curve as shown in FIG. 2. In this case, the ball bearing 22 transmits the axial movement in both directions, because its respective outer and inner rings are fixed at the camming gear element 8 and at the bushing 20 by means of locking rings 50, 51. A further locking ring 52 fixes the bushing 20 in the other load direction.

It should be noted that the bushing 21 cannot be given the form of an eccentric bushing having an eccentricity which corresponds to the eccentricity of the bushing 20, in which case the symmetry axis of the camming gear element 8 would be parallel with and displaced parallel to the symmetry axis 24 of the hollow shaft 1. The runner 13 would then roll at varying radial distances from the symmetry axis 24 as it rolls in the camming groove 9, and thus obtain a pulsating movement which is superposed on the axial, linear movement. This pulsation is extremely troublesome and cannot be permitted in the case of a distribution cylinder.

In the case of the FIG. 1 and FIG. 2 embodiments, it has been found that the runner is subjected to an undesirable acceleration boost as it runs along the steepest part of the rising parts of the sinusoidal curve. In this region of the camming curve, the runner moves "uphill". This acceleration boost is expressed as an impact force on the runner, causing the cylinder 2 to be displaced axially through a distance corresponding to 74 μm. This is an imperfection, or shortcoming, which is unimportant at low cylinder rotational speeds but which at high cylinder speeds is disadvantageous, because the camming groove will become worn in this region of the groove and because the acceleration boost becomes greater with higher cylinder rotational speeds.

In order to eliminate this imperfection, the camming gear element 8 is divided into two units, viz a camming element 8A and a toothed element 8B. The aforedescribed bushing 21 and ball bearing 23 are omitted from this embodiment and are, instead, replaced with the ball bearing 23A which is fitted directly on the hollow shaft 1. The camming element 8A is now journalled excentrically around the hollow shaft 1 with the aid of a needle bearing 40 and the ball bearing 23A. Thus, in this embodiment, the camming surfaces 10 and 11 will always be perpendicular to the symmetry axis 24 during rotation of the camming element 8A. This avoids the aforesaid problem of augmented acceleration in the steep part of the camming curve.

The symmetry axis 25A of the cylindrical toothed element 8B is now inclined at a greater angle to the symmetry axis 24 than in the earlier case. In this case, the angle V is 0.85 degrees. The angle of inclination is greater, because the eccentricity of the bushing 20 is the same as in the FIG. 1 embodiment. In view of the high balancing requirements which prevail at the aforesaid high rotational speeds, the left end-part 41 of the toothed element 8B is fitted loosely over the needle bearing 40 and is supported mechanically thereby. When the toothed element 8B rotates, the end-part 41 will not roll-off on the outer annulus of the needle bearing, but will slide axially on the needle bearing to some slight extent. The toothed element 8B rotates about a stationary symmetry axis 25A which forms an angle 2 V degrees in relation to the symmetry axis 24 of the hollow shaft, and this rotational movement is converted to a rotational movement which is centered around the symmetry axis 24, with the aid of a coupling element described in more detail herebelow.

According to a first embodiment of the invention, the aforesaid coupling element is comprised of a number of axially-directed spring pins 42 and a slightly elastic plate 43 which is fitted between the opposing end-surfaces of the camming element 8A and the toothed element 8B. The spring pins 42 are evenly spaced around the circumferential surface of the cylindrical toothed element and are directed axially. The pins 42 are pressed into the bore 45 in the end-surface of the camming gear element 8A and extend freely in a widened part 44 of the bore 45, the pins lying in the bottom part of the bore with a light running fit. The pins 42 and the plate 43 thus form a coupling which will transmit true angular movement. One preferred embodiment of the invention comprises eight such spring pins. These spring pins thus transmit the torque deriving from the toothed element 8B.

Figure 3:
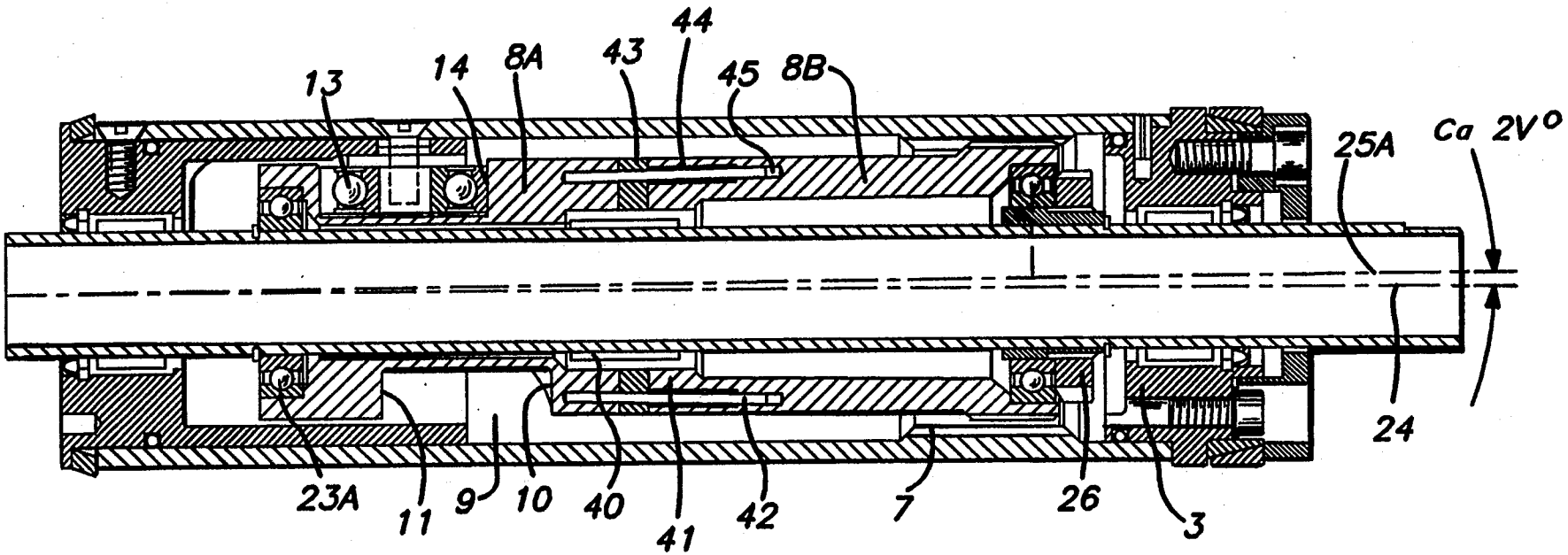
FIG. 3 is an axially sectioned view of still another embodiment of the inventive arrangement.

The axially acting load from the aforedescribed assembly, comprising the bushing 20, the ball bearings 22, 23A, the camming gear element 8A, the plate 43, the toothed element 8B and the coupling, is taken-up by the ball bearings 22, 23A. Although the plate 43 is not an imperative part of the coupling element, it affords a given degree of damping axially in the transmission, which is favorable to the length of useful life of the axially clamped ball bearings 22, 23A. If the plate 43 is excluded, the opposing end-surfaces on elements 8A and 8B press directly against one another. Because of the aforesaid inclination, a gap will always occur between the plate and the end-surface of the toothed element 8B, as shown in FIG. 3. This gap will always have the same position in relation to the stationary hollow shaft 1.

The runner 13 of this embodiment of the invention also has a cambered running surface 14. If the runner were not cambered, the upper part of the runner would strive to rotate at a faster speed than the lower part of said runner, seen in the directions shown in FIG. 3, since the upper part of the runner is radially spaced from the symmetry axis 24 at a greater distance than the bottom runner part. Slipping would thus occur.

Figure 4:
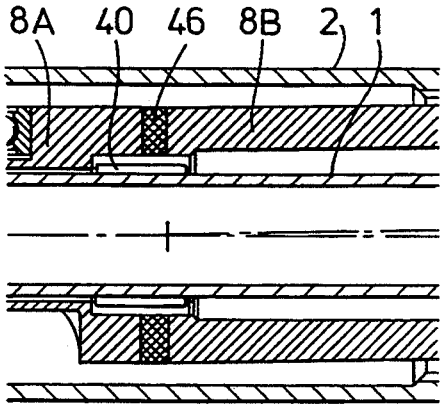
FIG. 4 illustrates a variant of the arrangement shown in FIG. 3.

FIG. 4 illustrates another variant of the coupling illustrated in FIG. 3, in which the plate and the spring pins have been replaced with a vulcanized elastic annulus 46. The annulus is vulcanized in the mutually opposing end-surfaces of the elements 8A and 8B.

Figure 5:
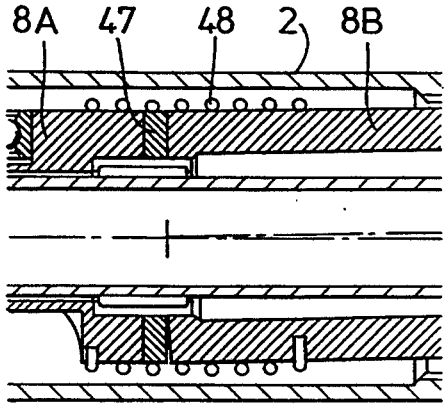
FIG. 5 illustrates another variant of the arrangement shown in FIG. 3.

FIG. 5 illustrates yet another embodiment of a coupling between the camming element 8A and the toothed element 8B. The coupling illustrated in FIG. 5 is comprised of a disc 47 and a coil spring 48 mounted on the outer surfaces of elements 8A and 8B. The coil spring has two end-parts, of which one is secured in the camming element 8A and the other is secured in the toothed element 8B, as shown at the bottom of FIG. 5.

Figure 6:
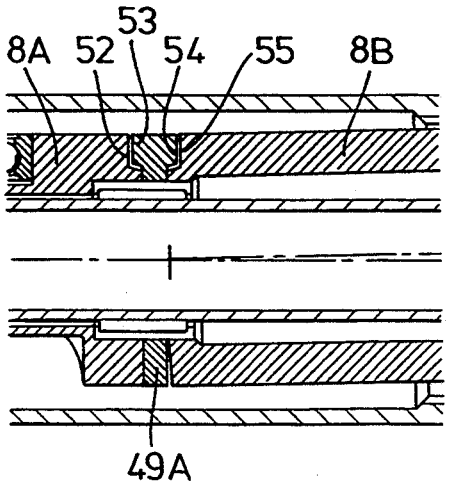
FIG. 6 illustrates another variant of the arrangement shown in FIG. 3.

FIG. 6 illustrates another embodiment of a coupling between the camming element 8A and the toothed element 8B. The coupling of this embodiment is comprised of a disc 49A provided with teeth 53, 54 which fit into grooves 52, 55 provided in the end-surfaces of the camming element 8A and the toothed element 8B.

Arcuate toothed couplings may also be used instead of the illustrated couplings. An arcuate toothed coupling is a known element comprised of a sleeve having a toothed annulus comprising outstanding teeth which mesh with the internal teeth of a further toothed annulus in a further sleeve. The sleeves are inserted one into the other so that the teeth will be in engagement with one another, enabling angular transmission of the rotary movement.

Other types of homokinetic couplings may also be used.

The invention solves the problems mentioned in the introduction as a result of the following advantages and fundamental features:

a) Each component can be balanced individually. Very few elements are used. No element is present which can give rise to vibrations and imbalances due to wear, such vibrations and imbalances being likely to occur when, e.g, x-y-linkage guides, arcuate toothed couplings and the like are used.

b) The cylindrical camming gear element 8 includes both eccentric annuluses 10 and camming groove. Because the aforesaid gearwheel 10 is slightly conical, good abutment is obtained with the internal tooth and therewith small losses. The runner 13 is self-adjusting on the camming surfaces, thereby avoiding edge abutment. This results in only small losses. The cylindrical camming gear element 8 is journalled in ball bearings which are only lightly clamped in an axial direction, resulting in only small losses.

c) Because power losses are small and the temperatures generated in operation are low, the useful length of life is long, as are also the periods between servicing.

d) The cylindrical camming gear element 8 replaces many expensive and sensitive components, thereby contributing to a low price.

Although the invention has been described with reference to distribution cylinders, it can be applied equally as well to other types of cylinders or rollers with which rotary movement of the roller shall be converted to a slow, axially reciprocating roller movement.

I claim:

1. An arrangement for converting the rotational movement of a roller to an axially reciprocating roller movement, comprising a stationary shaft (1) having a symmetry axis 24;

a cylinder (2) which is to be fixed to said roller, and which is journalled by journals for rapid rotation around the stationary shaft and for axial movement along said stationary shaft;

an eccentric gear (7, 10) for reducing the rotational speed of the cylinder, said eccentric gear comprising a toothed annulus (7) having internal teeth and an eccentrically journalled toothed annulus (10) having external teeth; a cylindrical camming gear element (8; 8A) which is fixed axially on the stationary shaft and is journalled by journals obliquely in relation to the symmetry axis (24) at an angle V for rotation around the symmetry axis 24 of said shaft, said camming gear element having at one end thereof the toothed annulus 10 and at the other end a camming groove (9);

a coupling means (8; 42, 43; 46; 48; 49A) for transmitting rotational movement of the eccentrically journalled toothed annulus to the camming gear element (8; 8A) and;

a runner-camming groove-unit (13) which is mounted in the camming groove (9) and between the camming gear element (8; 8A) and the cylinder (2) for converting rotational movement of the camming gear element to an axially reciprocating movement of the cylinder (2).

2. An arrangement according to claim 1, charaterized in that the cylindrical camming gear element is divided into a cylindrical camming element (8A) with the camming groove (9), and a cylindrical toothed element (8B) with the eccentrically toothed annulus (10);

in that the cylindrical camming element (8A) is journalled for rotation around the symmetry axis (24) of the stationary shaft with the aid of journals (40) mounted at one end-surface of the camming element and a bearing (23A) mounted at the other end surface of said camming element; and in that a torque transmission means (42, 43; 46; 48; 49A) connects the camming element (8A) with the toothed element (8B).

3. An arrangement according to claim 2, charaterized in that the torque transmission means includes spring pins (42) which are mounted in axial bores (45) in opposing end-surfaces of the camming and toothed elements (8A, 8B) so as to take-up torque.

4. An arrangement according to claim 3, characterized by an elastic disc (43) mounted between the opposing end-surfaces of the camming and toothed elements (8A, 8B) so as to provide limited axial springiness.

5. An arrangement according to claim 2, characterized in that the torque transmission means includes a coil spring (48) which connects together the two opposing camming and toothed elements (8A, 8B); and in that the coil spring is anchored at one end in the camming element (8A) and at the other end in the toothed element (8B).

6. An arrangement according to claim 5, characterized by an elastic disc (47) mounted between the opposing end-surfaces of the camming and toothed elements (8A, 8B) so as to provide limited axial springiness.

7. An arrangement according to claim 2, characterized in that the torque transmission means includes an elastic disc (46) which is vulcanized to each of the two opposing end-surfaces of the camming and toothed elements (8A, 8B).

8. An arrangement according to claim 2, characterized in that the torque transmission means includes a disc having axially outwardly-projecting projections (53, 54) and projection-receiving grooves (52, 55) disposed in the opposing end-surfaces of the camming and toothed elements (8A, 8B).

9. An arrangement according to claim 1, characterized in that the other end of the cylindrical camming gear element (8) is journalled by said journals, said journals including an angled first bushing (21) having a ball bearing (23), and the one end of said camming gear element is journalled by said journals, said journals including an angled second bushing (20) having a ball bearing (22), said second bushing having the form of an eccentric; and in that the angle at which the bushings (20, 21) are inclined is equal to the angle (V) at which the symmetry axis (25) of the camming gear element is inclined to the symmetry axis (24) of the stationary shaft.

10. An arrangement according to claim 1, characterized in that the teeth of the toothed annulus (10) in relation to the axial direction of the cylindrical camming gear element (8) are conical and have an angle of conicity of 2× said V.

* * * * *